United States Patent [19]

Yamaoka

[11] Patent Number: 4,486,525

[45] Date of Patent: Dec. 4, 1984

[54] MULTIPLE COPYING PROCESS WITH IMPROVED IMAGE RETENTION

[75] Inventor: Toshihide Yamaoka, Mitaka, Japan

[73] Assignee: Olympus Optical Company Limited, Tokyo, Japan

[21] Appl. No.: 320,522

[22] Filed: Nov. 12, 1981

[30] Foreign Application Priority Data

Nov. 12, 1980 [JP] Japan ..... 55/158088

[51] Int. Cl.[3] ..... G03G 13/09

[52] U.S. Cl. ..... 430/122; 430/106.6

[58] Field of Search ..... 430/106.6, 122, 108

[56] References Cited

U.S. PATENT DOCUMENTS 4,238,558 12/1980 Ziolo ..... 430/106.6
4,239,845 12/1980 Tanaka et al. ..... 430/106.6
4,242,434 12/1980 Hirakura et al. ..... 430/106.6
4,265,993 5/1981 Kawanishi et al. ..... 430/106.6

*Primary Examiner*—John E. Kittle
*Assistant Examiner*—John L. Goodrow
*Attorney, Agent, or Firm*—Fleit, Jacobson, Cohn & Price

[57] ABSTRACT

The disclosed process produces a plurality of copies of an original by repeating development of the same electrostatic latent image of the original once formed on a charge retentive member and transfer of the thus developed image onto plural sheets of recording paper, wherein the development is effected by using a magnetic brush having a non-magnetic sleeve with an electrically-insulating surface layer and a two-component developer containing toner and a carrier with a volume resistivity of less than $10^{10}$ Ω·cm and higher than $10^{7}$ Ω·cm.

4 Claims, 3 Drawing Figures

MULTIPLE COPYING PROCESS WITH IMPROVED IMAGE RETENTION

BACKGROUND OF THE INVENTION

1. Field of the Invention

This invention relates to an electrophotographic copying process for producing a plurality of copies from the same electrostatic latent image of an original formed on an electrostatic charge retentive member, by repeating development of the electrostatic latent image and transfer of the thus developed image to image receiving members.

2. Description of the Prior Art

To obtain a plurality of high quality copies from the same electrostatic latent image formed on an electrostatic charge retentive member, it is important to maintain the stable electrostatic latent image of the original on the electrostatic charge retentive member, such as a rotary photosensitive drum, throughout the copy production cycle. In practice, however, the electrostatic charge leaks from the electrostatic latent image for various reasons, so that it is very difficult to ensure high picture quality throughout a plurality of copies made by the repeated development and transfer of the one latent image. One of the causes of such deterioration of the electrostatic latent image is the transfer of electrostatic charge during the development. Such electrostatic charge transfer is due to leakage of the electrostatic charge of the latent image from the electrostatic charge retentive member through the developer or injection of unwanted electrostatic charge onto the electrostatic charge retentive member through the developer. More specifically, it has been known that such deterioration of the electrostatic latent image tends to occur in the case of a magnetic brush developing unit which uses a combination of two-component developer containing magnetic carrier and toner and an electrically-conductive non-magnetic sleeve such as an aluminium sleeve. It is believed that the magnetic carrier particles are electrically conductive and allow the leakage and injection of electrostatic charge.

Several proposals have been made to overcome the shortcoming. For instance, one proposal is to insulate the surfaces of the magnetic carrier particles by coating the surfaces with resin or the like. This proposal is effective but has shortcomings in that the process of producing the magnetic carrier is complicated by the need for special insulating treatment. Further the process is expensive because of the need for special equipment to accomplish the insulating treatment.

Another proposal is to provide an electric insulating layer on the surface of the non-magnetic sleeve. This proposal can be effected comparatively easily at relatively low cost but has a shortcoming in that, in the case of copying a solid picture, front edges of the copied picture tend to lose picture density as the number of copies increases. Despite that, high picture quality can be maintained from the first copy to the last copy in the case of copying a linear picture, as confirmed by experiments.

The decrease in print density at the front edge of the solid picture may be mitigated by increasing the developing efficiency, e.g. by increasing the toner concentration. However, in such a case the linear picture might be over-developed and might become thick. Further, the background of the image might be undesirously developed to some extent. In this connection it should be noted that the single document image may include both the solid picture and the linear picture. Therefore, in the known process it is very difficult to develop both the linear picture and the solid picture in an optimum manner.

SUMMARY OF THE INVENTION

Therefore, an object of the present invention is to obviate the aforesaid shortcomings of the prior art by providing an improved multiple copying process, which process prevents deterioration of an electrostatic latent image throughout production of a plurality of copies in an easy and inexpensive manner so as to facilitate stable reproduction of both linear pictures and solid pictures even in the same document image over a large number of copies.

To fulfill the object, the process of the present invention comprises the steps of producing an electrostatic latent image of an original to be copied on an electrostatic charge retentive member, developing the latent image by a magnetic brush developing unit using a combination of a non-magnetic sleeve with an electrically-insulating surface layer and a two-component developer containing a low-resistance carrier with a volume resistivity of less than $10^{11}$ Ω·cm, preferably less than $10^{10}$ Ω·cm and toner, transferring the thus developed image onto an image receiving member, and repeating said developing and said transferring steps until the desired number of copies are formed.

BRIEF DESCRIPTION OF THE DRAWINGS

For a better understanding of the invention, reference is made to the accompanying drawings, in which:

In FIGS. 1 and 2, 1 is an original, 2 and 3 are pairs of feeding rollers, 4 is an illuminating lamp, 5 is an optical system, 6 is a rotary photosensitive drum as an electrostatic charge retentive member, 7 is a discharging lamp, 8 is a corona charger, 9 is a toner developing unit of the magnetic brush development type, 10 is a toner image transfer station, 11 is a recording paper cassette, 12 is recording paper as an image receiving member, 13 is a pickup roller, 14 is register rollers, 15 is a transfer roller, 16 is a guide, 17 is a pair of guide rollers, 18 is a fixing unit, 19 is a pair of feed rollers, 20 is a cleaner brush, 21 is a fan, 22 is a filter, 23 is a housing, 24 is a shaft, 25 is a separator pawl, 26 is an air duct, 27 is an opening, 28 and 29 are switches, 30 is a non-magnetic sleeve, 30A is an insulating layer, and 31 is a permanent magnet.

DESCRIPTION OF THE PREFERRED EMBODIMENT

Figure 1:
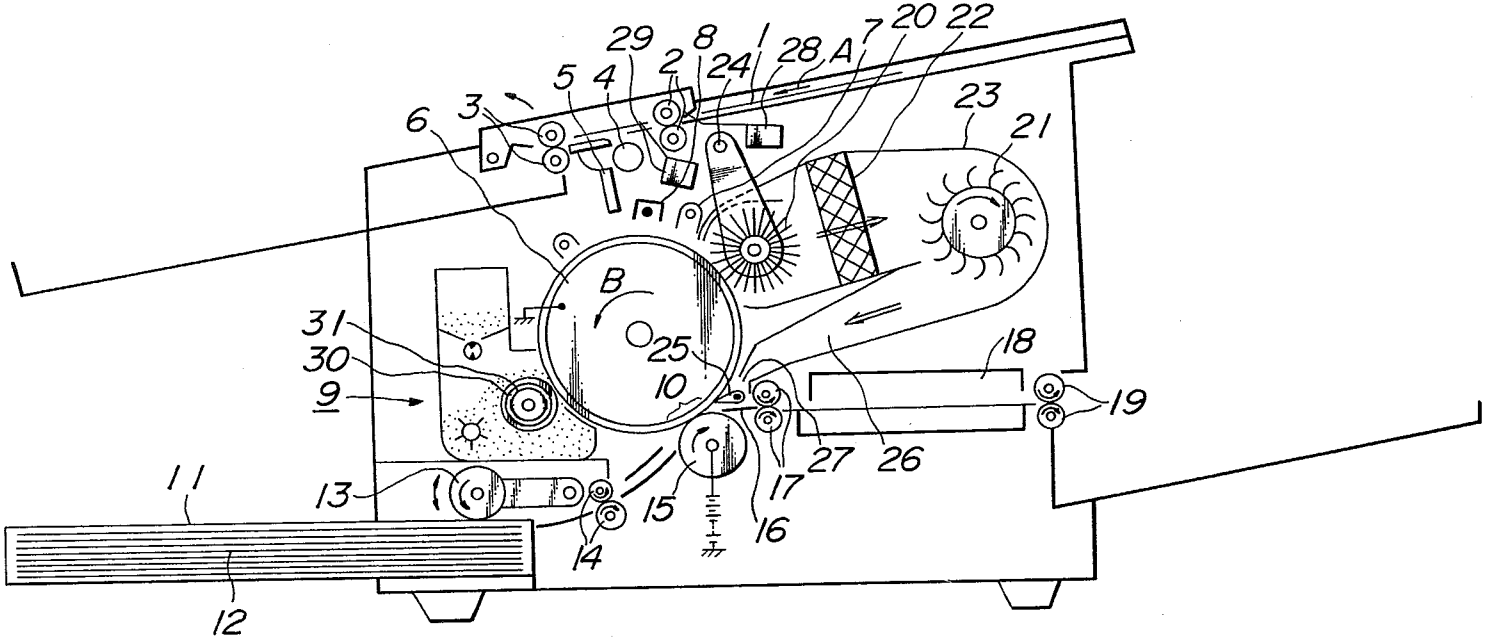
FIG. 1 is a schematic sectional view of a multiple copying machine for carrying out the multiple copying process of the present invention.

FIG. 1 schematically shows the construction of a multiple copying machine to which the multiple copying process of the present invention is applied. When a sheet-like original 1 to be copied is placed on an inclined original table and moved in the direction of the arrow A, two pairs of feeding rollers 2 and 3 act to forward the original 1. When moving between the feeding rollers 2 and 3, the original 1 passes above an illuminating lamp 4 and an optical system 5. The optical system 5 projects an image of the illuminated original 1 onto a rotary photosensitive drum 6 acting as an electrostatic charge retentive member. The photosensitive drum 6 rotates in the direction of the arrow B, and after being discharged by a discharging lamp 7, the photosensitive drum 6 is uniformly charged by a corona charger 8, so that upon projection of the aforesaid image of the original 1, an electrostatic latent image is formed thereon. This latent image is toner-developed by a toner developing unit 9, and then the thus developed image is forwarded to a toner image transfer station 10 as the photosensitive drum 6 rotates.

A recording paper cassette 11 carries a number of sheets of recording paper 12 each sheet acting as an image receiving member. A swaying rotary pickup roller 13 picks up the recording paper 12 one sheet at a time, so as to feed the recording paper 12 to the toner image transfer station 10 through the pair of register rollers 14. In the toner image transfer station 10, the recording paper 12 passes between the photosensitive drum 6 and a transfer roller 15, so that the recording paper 12 comes in contact with the aforesaid toner image and causes the toner image to be transferred to the recording paper 12. During the transfer, the recording paper 12 is kept in tight contact with the toner image and hence with the photosensitive drum 6, and after being separated from the drum 6, as will be described later, the recording paper 12 is forwarded along a guide 16 by the pair of rollers 17 toward a fixing unit 18. After the toner image is fixed at the fixing unit 18, the recording paper 12 is discharged to the outside of the copying machine by the pair of feed rollers 19.

When one copy is to be formed from the latent image on the photosensitive drum 6, the toner image on the photosensitive drum 6 is not wholly transferred to the recording paper 12, but partially remains on the drum 6, so that a rotary cleaner brush 20 brushes off the residual toner from the photosensitive drum 6. A fan 21 generates an air flow to suck the thus brushed off toner, and a filter 22 collects the toner particles from the air flow. A housing 23 encloses the cleaner brush 20 and the fan 21 to produce an effective suction for sucking the toner and to prevent the toner particles from being scattered in the apparatus.

On the other hand, when multiple copies are to be made from one electrostatic latent image once formed on the drum 6 by repeating the toner development and the transfer of the developed images to a plurality of recording papers 12, it is preferable not to clean the toner image after each transfer. Thus, the embodiment of FIG. 1 allows the cleaner brush 20 to be moved away from the drum 6 by pivoting the cleaner brush about a shaft 24.

To separate the recording paper 12 from the drum 6, the embodiment of FIG. 1 uses a combination of a separator pawl 25 and air flow thereto from the opening 27 of an air duct 26 defined by the housing 23. Switches 28 and 29 detect the position of the original 1, so as to facilitate the start of the copying machine upon insertion of the original 1 thereto and the control of the operations of various parts thereof in synchronism with the movement of the original 1.

In the present invention, the toner developing unit 9 is of the magnetic brush development type, and a two-component developer containing magnetic carrier and toner is used in the developing unit 9. A non-magnetic sleeve 30 such as an aluminium sleeve is rotatably mounted in the developing unit 9 and a permanent magnet assembly 31 is disposed within the non-magnetic sleeve 30.

Figure 2:
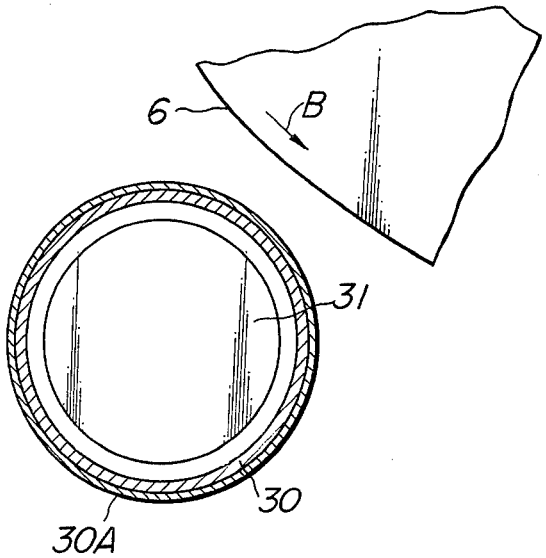
FIG. 2 is a cross sectional view showing a non-magnetic sleeve with an insulating layer.

To prevent the deterioration of the electrostatic latent image on the drum 6 during the repeated developments, according to the present invention an electrically insulating layer 30A is applied on the surface of the non-magnetic sleeve 30 of the developing unit 9 of the magnetic brush development type as illustrated in FIG. 2. The insulating layer 30A effectively prevents the leakage of electrostatic charge via the developer and the sleeve 30 and accordingly prevents the reduction of the potential of the electrostatic latent image.

Figure 3:
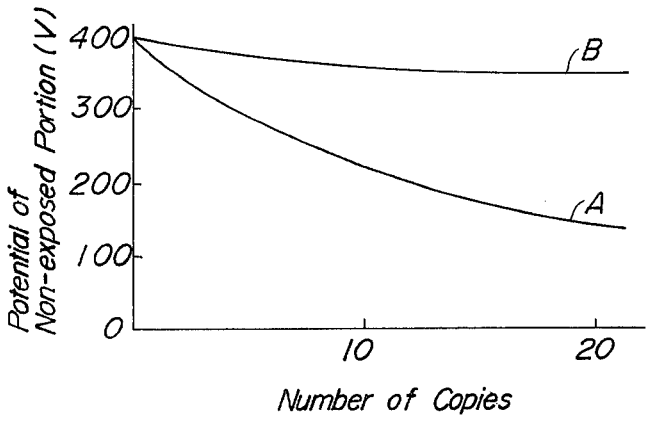
FIG. 3 is a graph showing variations of electric potentials of electrostatic latent images when using an electrically-conductive sleeve and an electrically-insulating sleeve.

Tests were made on the variation of the potential of an electrostatic image as the number of copies thereof increased in the case of using a combination of an electrically-conductive aluminium sleeve and carrier treated by regular surface oxidation so as to have a resistivity of not less than $10^{10}$ Ω·cm and the case of using a combination of an aluminium sleeve with an aluminium oxide layer formed on the surface thereof and said carrier. FIG. 3 shows the result of the tests. Curve A of the figure shows the variation in the case of using the electrically-conductive sleeve. The electrostatic potential of the electrostatic image decreased greatly as the number of copies increased. On the other hand, in the case of using the electrically-insulating sleeve, the potential of the electrostatic latent image substantially unchanged even when the number of copies increased, as shown by curve B.

The tests of making a plurality of copies from one electrostatic latent image showed that, in the case of linear pictures, the last one of the thus made copies maintained substantially the same picture quality as that of the first copy, whereas in the case of solid pictures, the print density at front edges of the copied image became lower as the number of copies increased. To prevent the deterioration of the picture quality in the case of making a plurality of copies from one electrostatic latent image, further tests were made by using different developers containing carriers with different resistivities. As a result, it was found through the tests that, contrary to the conventional common sense, if an electrically-insulating sleeve was used, the smaller the resistivity of the carrier was in a certain range, the smaller the deterioration of the picture quality was after making a plurality of copies from one electrostatic latent image. In short, it was confirmed by various tests that the suitable range of volume resistivity of the carrier was $10^7$ to $10^{11}$ Ω·cm, preferably $10^8$ to $10^{10}$ Ω·cm.

More specifically, five kinds of carriers $C_1$ through $C_5$ were prepared as shown in Table 1.

TABLE 1

| Carrier | Treatment | Volume resistivity (Ω · cm) |
|---|---|---|
| $C_1$ | Iron powder without surface oxidation treatment | $2.0 \times 10^4$ |
| $C_2$ | Iron powder with light surface oxidation treatment | $6.5 \times 10^6$ |
| $C_3$ | Iron powder with medium surface oxidation treatment | $1.3 \times 10^9$ |
| $C_4$ | Iron powder with heavy surface oxidation treatment | $1.4 \times 10^{11}$ |
| $C_5$ | Iron powder coated with acrylic resin | $4.7 \times 10^{13}$ |

All the carriers $C_1$ through $C_5$ had substantially the same grain shapes, and the grain size distribution of the carriers were adjusted so that 90% by weight of each carrier was in a grain size range of 50 to 100μ. The volume resistivities of Table 1 were determined by placing each carrier in a space between two cylindrical piston-like electrodes disposed with a spacing of 15 mm therebetween, the electrodes having an effective surface area of 5 $cm^2$, loading a weight of 1 kg from the upper side electrode, applying a DC voltage of 100 V across the electrodes, and taking measurement one minute after applying the DC voltage.

Two-component developers were prepared by mixing toner and each of the carriers $C_1$ through $C_5$, so that each of the developers had a toner concentration of 8% by weight. Tests of picture quality were carried out by using the developers thus prepared in two kinds of developing units, namely one developing unit having the electrically-conductive aluminium sleeve and another developing unit having the aluminium sleeve with aluminium oxide layer. The picture quality was evaluated by taking 20 copies from one electrostatic latent image and checking the picture quality of the twentieth copy. Table 2 shows the result of the picture quality tests.

TABLE 2

| | Electrically-insulating sleeve | | Electrically-conductive sleeve | |
|---|---|---|---|---|
| Carrier | Solid picture | Linear picture | Solid picture | Linear picture |
| $C_1$ | Fair | Unsatisfactory | Unsatisfactory | Unsatisfactory |
| $C_2$ | Good | Fair | Unsatisfactory | Unsatisfactory |
| $C_3$ | Good | Good | Fair | Unsatisfactory |
| $C_4$ | Unsatisfactory | Good | Fair | Fair |
| $C_5$ | Unsatisfactory | Fair | Fair | Fair |

As can be seen from Table 2, the combination of the electrically-insulating sleeve and the low-resistance carrier provided the same high picture quality in the twentieth copy as that of the first copy for both the solid picture and the linear picture being copied. Further tests were made by changing the resistivities of the carriers, and it was found that the suitable range of the volume resistivity of the carrier was $10^7$ to $10^{11}$ Ω·cm, preferably $10^8$ to $10^{10}$ Ω·cm. The preferable resistivity of the electrically-insulating surface layer 30A on the surface of the non-magnetic sleeve 30 was found to be $10^8$ to $10^{12}$ Ω·cm, preferably about $10^{10}$ Ω·cm.

The reason why the excellent stability of the picture quality, far exceeding that expected can be achieved by using the aforesaid combination of the low-resistance carrier and the electrically-insulating sleeve is not clear yet. It is believed that factors other than the leakage of electrostatic charge contribute to the high picture quality achieved by the present invention, because, when developers containing various electrically-insulating carriers were used to make a plurality of copies from one electrostatic latent image, the electric potential of the electrostatic latent image at twentieth copies was substantially the same as that at the first copies.

It should be noted that the present invention is not restricted to the illustrated embodiment alone, and numerous modifications are possible. For instance, the non-magnetic aluminium sleeve with the aluminium oxide surface layer used in the embodiment can be replaced by a plastic sleeve of hollow cylindrical shape. Besides, the iron powder of the carrier in the illustrated embodiment can be replaced with powder of nickel, ferrite, or the like.

What is claimed is:

1. A multiple copying process, comprising the steps of:

producing an electrostatic latent image of an original to be duplicated on a electrostatic charge retentive member;

providing a magnetic brush developing unit including a non-magnetic sleeve and a permanent magnet assembly disposed within the sleeve, the sleeve including an electrically-insulating surface layer having a resistivity of $10^8$ to $10^{12}$ ohm cm;

developing the latent image to form a toner image by said magnetic brush developing unit using a two-component developer containing a low-resistance carrier with a volume resistivity of less than $10^{10}$ ohm cm and higher than $10^8$ ohm cm and a toner;

transferring the thus developed toner image onto an image receiving member; and repeating said developing and said transferring for the same and single electrostatic latent image once formed on the electrostatic charge retentive member to form a desired number of copies.

2. A multiple copying process as set forth in claim 1, wherein the electrically-insulating surface layer of the non-magnetic sleeve has a resistivity of about $10^{10}$ Ω·cm.

3. A multiple copying process as set forth in claim 1, wherein said non-magnetic sleeve is an aluminium sleeve and said electrically insulating surface layer is an aluminium oxide layer.

4. A multiple copying process as set forth in claim 1, wherein said carrier is selected from the group consisting of iron powder, nickel powder, and ferrite powder.

* * * * *